US008550869B2

(12) United States Patent
Koonce, Jr.

(10) Patent No.: US 8,550,869 B2
(45) Date of Patent: Oct. 8, 2013

(54) ILLUMINATION APPARATUS AND METHOD OF USING

(76) Inventor: Nathaniel C. Koonce, Jr., Coral Springs, FL (US)

( * ) Notice: Subject to any disclaimer, the term of this patent is extended or adjusted under 35 U.S.C. 154(b) by 336 days.

(21) Appl. No.: 13/073,347

(22) Filed: Mar. 28, 2011

(65) Prior Publication Data

US 2011/0170284 A1 Jul. 14, 2011

Related U.S. Application Data

(63) Continuation-in-part of application No. 12/539,072, filed on Aug. 11, 2009, now Pat. No. 7,914,360.

(60) Provisional application No. 61/188,774, filed on Aug. 13, 2008.

(51) Int. Cl.
*A63H 33/22* (2006.01)
*A63H 3/06* (2006.01)

(52) U.S. Cl.
USPC ..... 446/219; 446/220; 362/190

(58) Field of Classification Search
USPC ..... 446/219, 220, 222, 226, 484; 362/352, 362/190, 253, 806, 811
See application file for complete search history.

(56) References Cited

U.S. PATENT DOCUMENTS 3,672,083 A * 6/1972 Moran ..... 40/540
5,075,830 A * 12/1991 Perez ..... 362/352
5,117,344 A * 5/1992 Perez ..... 362/352
5,183,329 A * 2/1993 Chen ..... 362/352
5,947,581 A * 9/1999 Schrimmer et al. ..... 362/96

* cited by examiner

*Primary Examiner* — Kien Nguyen
(74) *Attorney, Agent, or Firm* — David W. Barman

(57) ABSTRACT

An illuminated display assembly is provided with an article having an inner surface and an outer surface defining a body, said body constructed and arranged to have at least a portion thereof clear, transparent, translucent, or combinations thereof defining an interior, and a light patch placed on said article such that light illuminates said article and produces an illuminated article effect.

6 Claims, 12 Drawing Sheets

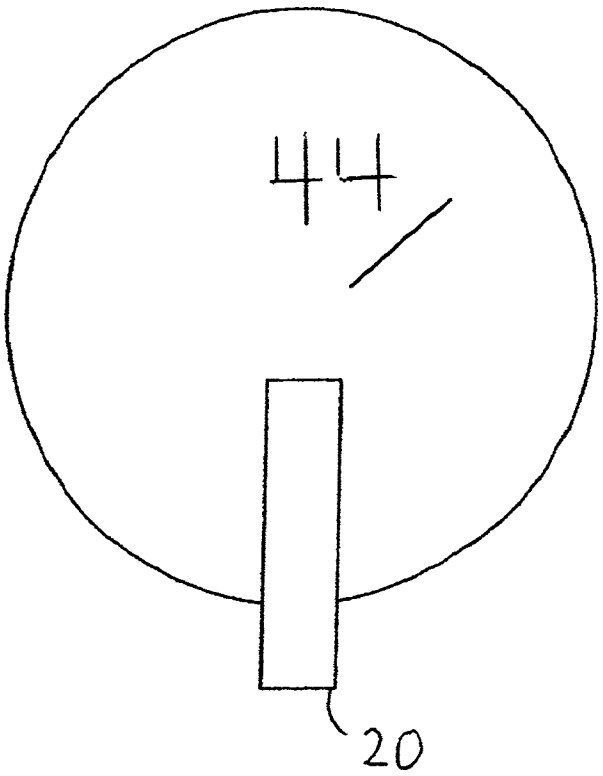
Fig. 10
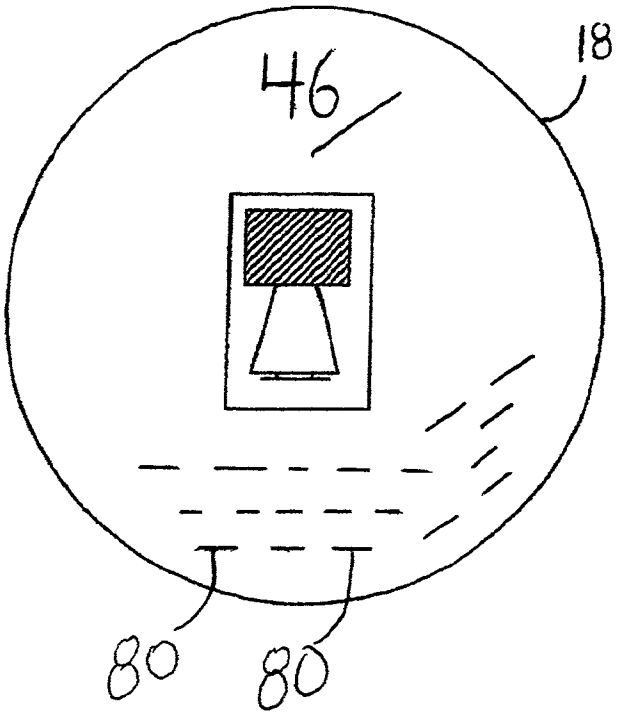

ILLUMINATION APPARATUS AND METHOD OF USING

CROSS-REFERENCE TO RELATED APPLICATIONS

This application is a continuation-in-part of U.S. patent application Ser. No. 12/539,072, filed Aug. 11, 2009 which claims benefit to Provisional Patent No. 61/188,174, filed Aug. 13, 2008, the disclosures of which are incorporated herein by reference in their entirety.

BACKGROUND OF THE INVENTION

Field of the Invention

The present invention relates generally to illuminated balloons, and more specifically, to an illuminated balloon having a translucent design on at a least portion of the balloon wherein light directed into the interior of the balloon from an externally attached electric lamp effectively illuminates the design.

Unlike many articles of manufacture, balloons have survived the test of time and continue to grow in popularity for use as gifts, displays, souvenirs, decorations, and the like. For years, balloons have been a source of visual enjoyment and entertainment, especially for children.

While most balloons, including the latex and the Mylar® type balloons, are particularly attractive in the daylight or other bright, well-lit atmospheres, their attractiveness cannot be fully appreciated at night or in dark places such as at the circus, evening sporting events, or simply outdoors during the evening hours. Unfortunately, these are the circumstances during which balloons are most often sold and meant to be enjoyed by the consumer and surrounding public.

There exists a need in the present balloon art for an illuminated balloon assembly adapted for use with virtually any known type of balloon wherein a light source is attachable to an outer surface of the balloon so as to direct light through an interior chamber thereof, illuminating the balloon and any design printed thereon. The light of the present balloon is positioned between a patch and the outer surface of the balloon.

SUMMARY OF THE INVENTION

The present invention is an illuminated display assembly, comprising:

a balloon having an inner surface and an outer surface defining a generally inflatable body and a neck portion integrally formed therewith, said inflatable body disposed in air tight, sealed relation about a hollow interior gas chamber, an electric lamp assembly attached to a patch;

said patch having a first side and a second side;

said second side of said patch having said electric lamp assembly attached thereto;

said second side of said patch further having adhesive disposed thereon, said adhesive for securing said patch to said outer surface of an inflated balloon;

whereby said electrical light assembly comprises an electrical light positioned on said second side of said patch such that said light is disposed between said patch and said outer surface of said inflated balloon;

said patch fixedly attached with adhesive to an outer surface of said inflatable body and structured and disposed to direct light into said interior gas chamber and at least partially out through said inflatable body, thereby effectively illuminating said balloon; and an electrical power supply, preferably comprising at least one battery. The battery may be any type of battery as is known.

The patch is made of any acceptable material that is substantially flexible including, but not limited to cloth, paper, polymers, combinations thereof, and the like.

The light is any light that produces illumination with minimal amount of heat generated. These include any electric component lamp device such as light emitting diodes (LED), electroluminescent wire (EL wire), plasma lights, organic light-emitting diodes (OLED), polymer light-emitting diodes (PLED), combinations thereof, and the like.

The assembly has an electrical power supply that includes a battery holder structured and arranged with a moveable tab accessible from the first side of said patch, whereby said moveable tab turns on and off said light. Preferably the light of the light assembly is wirelessly connected to the battery.

The assembly has a light supported by a light holder. The light on the light holder has an angular orientation relative to the patch such that said light holder forms an angle between 0.degree.-60.degree. relative to the inner surface of said patch. In a preferred embodiment, the angular orientation is about 45.degree.

The light is positioned between the patch and the outer surface of the balloon and is at least partially enveloped by the outer surface of the balloon.

The present invention is a fully integrated apparatus in a single patch that simply affixes to a balloon and illuminates the balloon when activated.

Additionally contemplated is a method of producing an enveloped illuminated balloon effect comprising the steps of:

providing an assembly according to claim 1;

moving said tab to turn on said light;

creating an enveloped illuminating effect on said balloon by virtue of said light, positioned between the patch and the outer surface of the balloon, being at least partially enveloped by the outer surface of the balloon.

A unique effect is produced from the light, held between the patch and the outer balloon surface. The present invention creates the "enveloped luminescent balloon effect." When the outer surface of the balloon at least partially envelopes the light, the light rays are altered and the enveloped luminescent balloon effect is created. It is a unique light patter in which light is scattered by virtue of a light being partially covered by the outer balloon surface and the light enveloped light passing through the balloon.

In one embodiment, the present invention includes an illuminated display assembly, comprising: an article having an inner surface and an outer surface defining a body, said body constructed and arranged to have at least a portion thereof clear, transparent, translucent, or combinations thereof defining an interior, wherein the interior is at least partially a cavity; an electric lamp assembly attached to a patch; said patch having a first side and a second side; said second side of said patch having said electric lamp assembly attached thereto; said second side of said patch further having adhesive disposed thereon, said adhesive for securing said patch to said outer surface; whereby said electrical light assembly comprises an electrical light positioned on said second side of said patch such that said light is disposed between said patch and said outer surface of said article; said patch fixedly attached with adhesive to an outer surface of said article and structured and disposed to direct light into said interior and at least partially out through said article, thereby effectively illuminating said article; and an electrical power supply.

The interior cavity facilitates the propagation of light from the patch and illuminates the article.

BRIEF DESCRIPTION OF THE SEVERAL VIEWS OF THE DRAWING

FIG. 10 shows top and bottom views of the patch, wherein the bottom surface has a plurality of light emitting structures.

DETAILED DESCRIPTION OF THE PREFERRED EMBODIMENT

Figure 1:
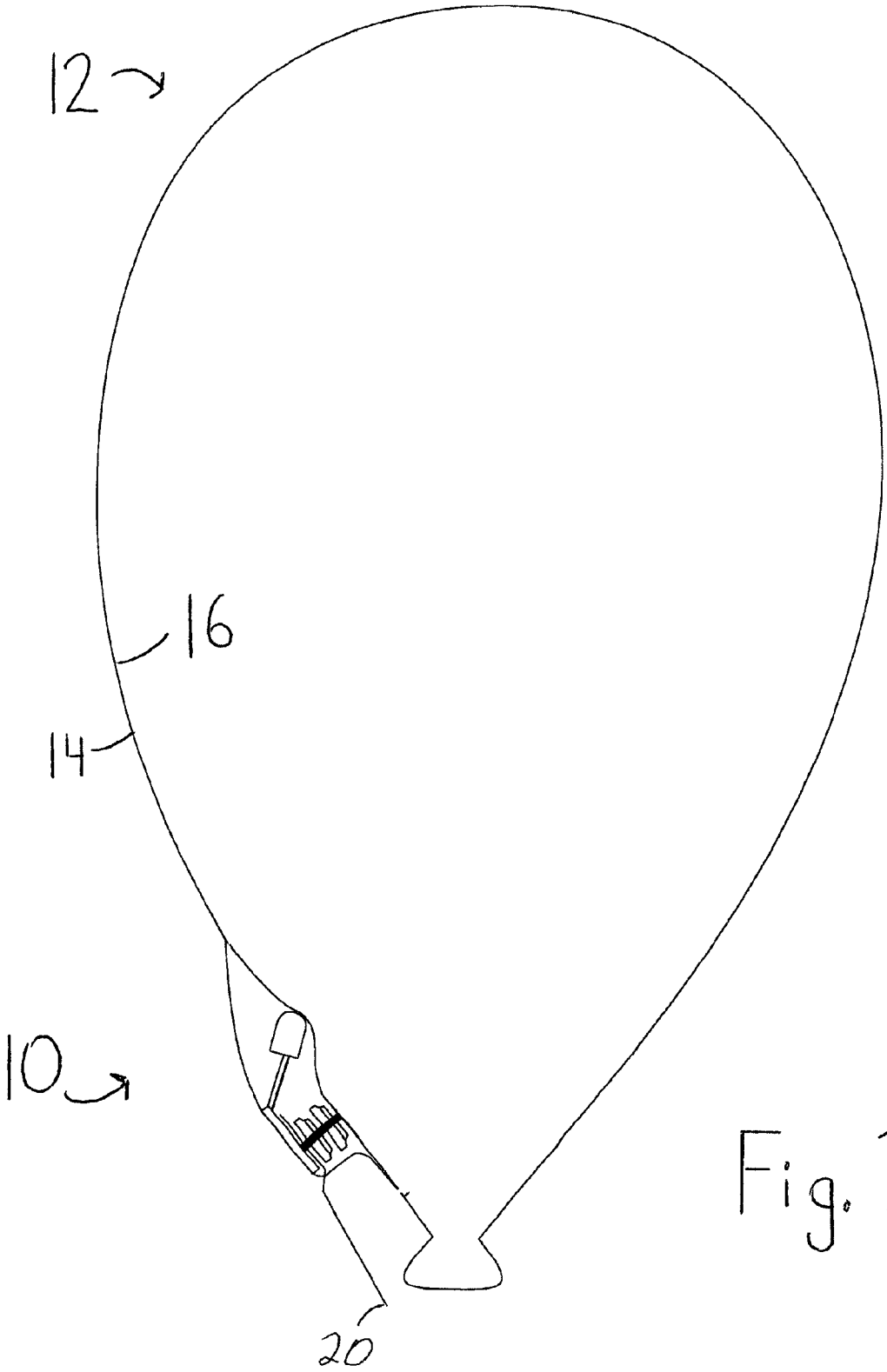
FIG. 1 is a side cross section view of the illuminated balloon assembly.
Figure 2:
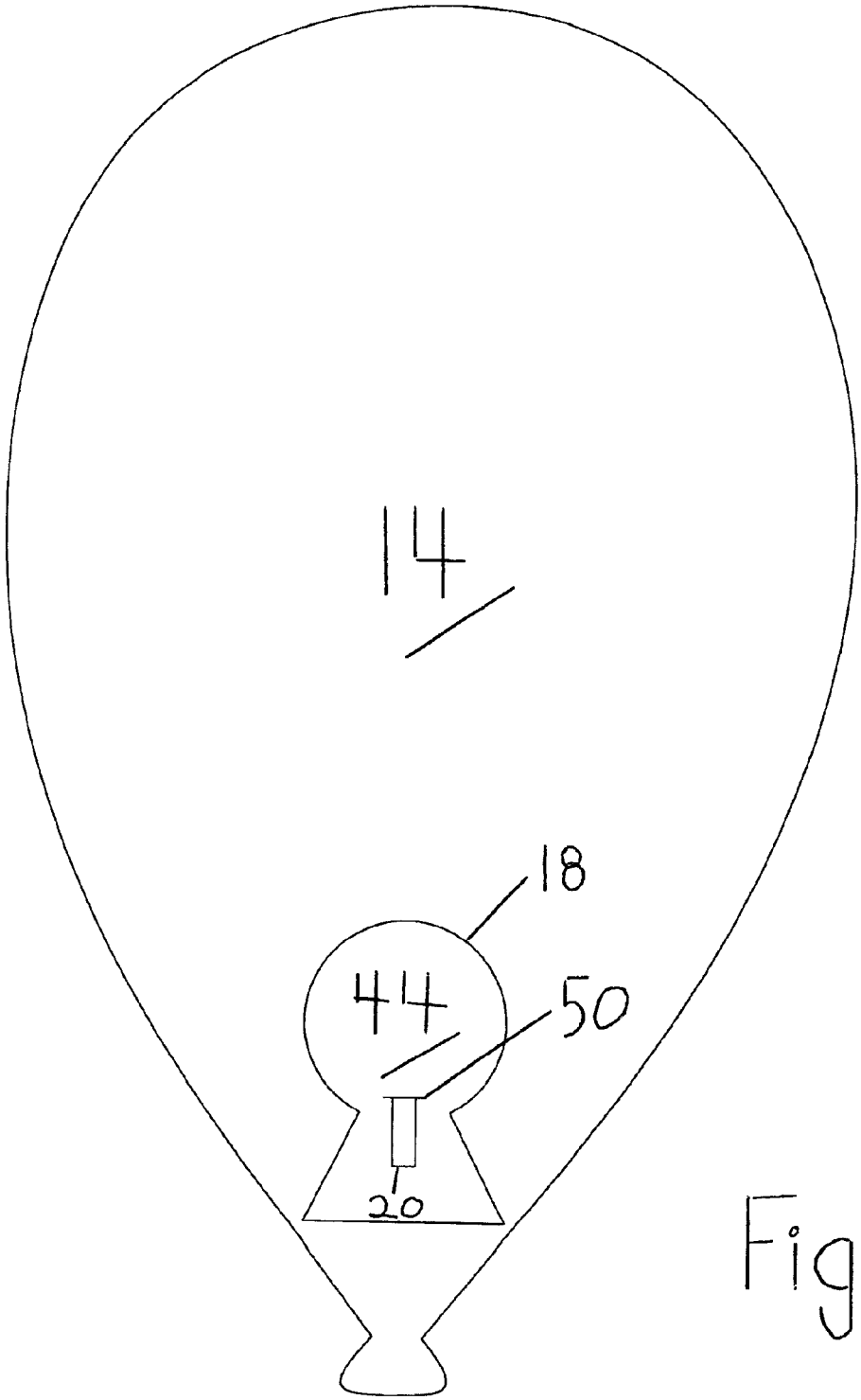
FIG. 2 is a front view of the illuminated balloon assembly.

The present invention is an illuminated balloon assembly 10. A balloon 12 includes an outer surface 14 and an inner surface 16. Patch 18 has a first side 44 and second side 46. A light assembly 40 is attached to second side 46 of patch 18. Assembly 40 includes a tab 21 with a first tab end 20 and a second tab end 22. Second tab end 22 is initially positioned between batteries 24 and electrical contact 26. Electrical contact 26 is on the inner side 42 of circuit board 28. Batteries 24 are urged towards contact 26 by battery encasement strap 34 that is connected both to circuit board 28 and battery encasement back 36. Compression tape 52 extends over battery encasement back 36 and secures to second side 46 of patch 18. Second side 46 has adhesive 48 disposed thereon. Circuit board 28 has light support arm 30 rigidly attached thereto. Light support arm 30 supports light 32 on the end of light support arm 30 that is opposite circuit board 28.

Figure 3:
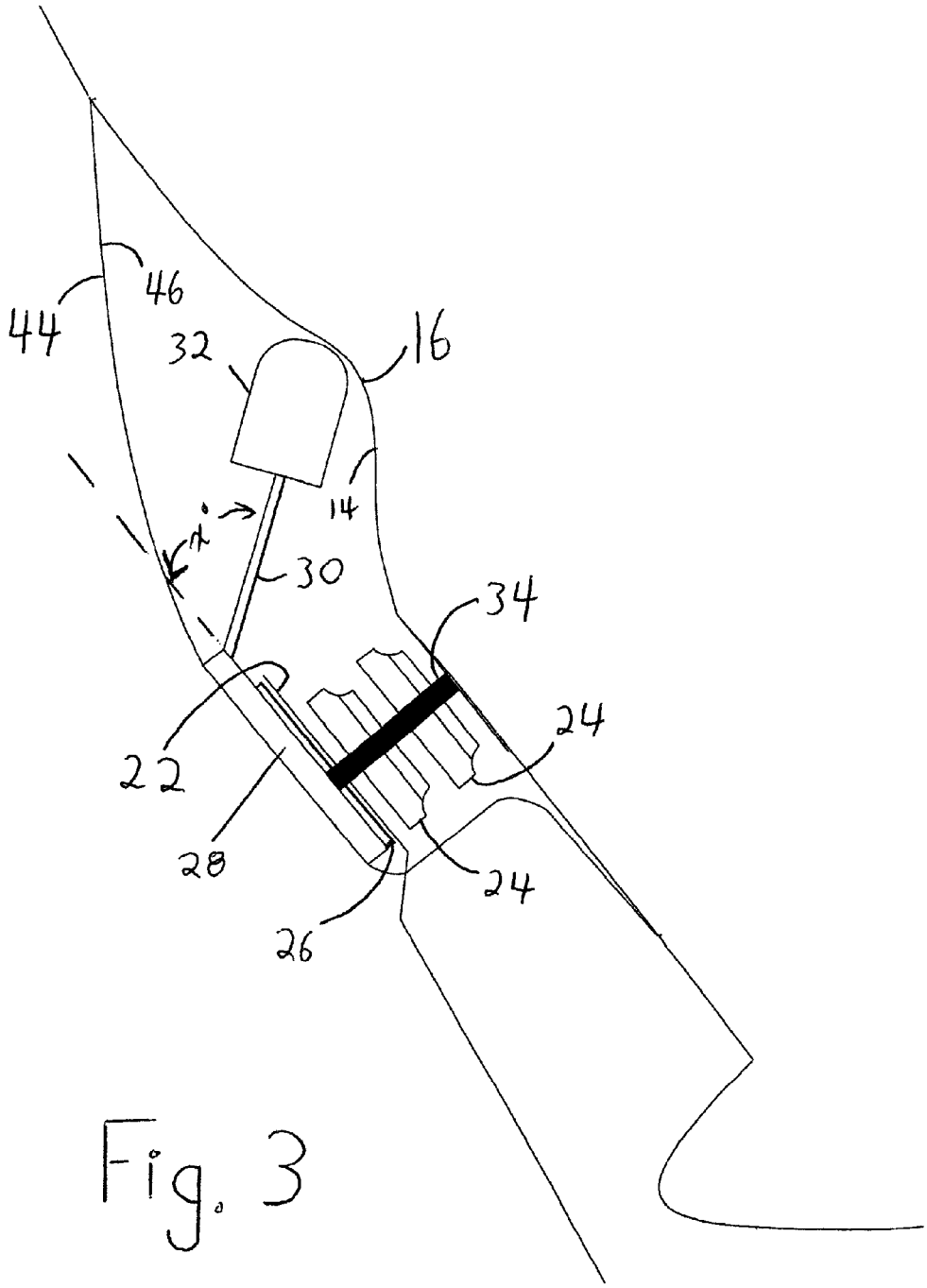
FIG. 3 is a side view cross section of the light assembly of the present invention with light positioned between a patch and the outer surface of a balloon.
Figure 4:
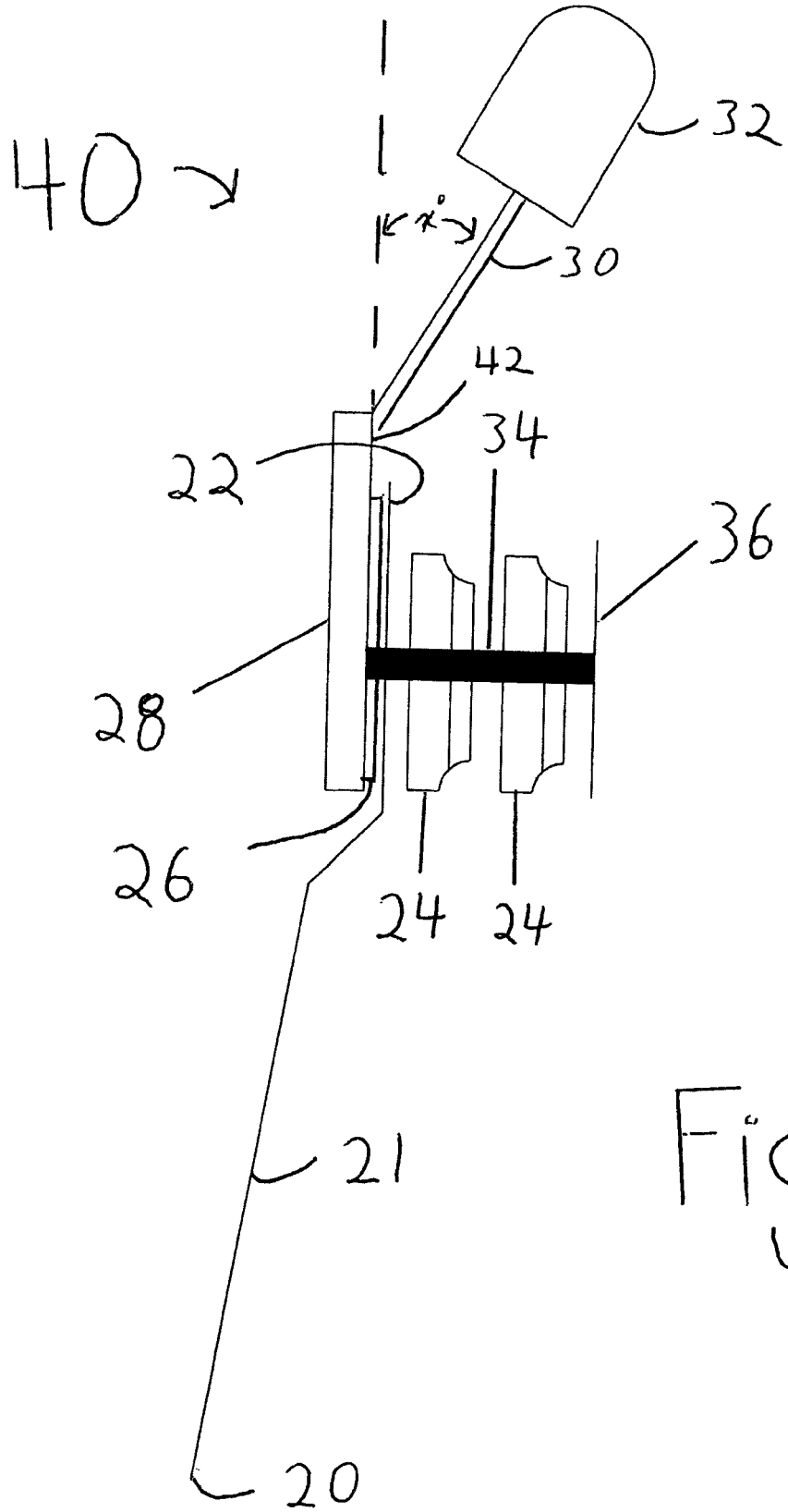
FIG. 4 is the light assembly.
Figure 5:
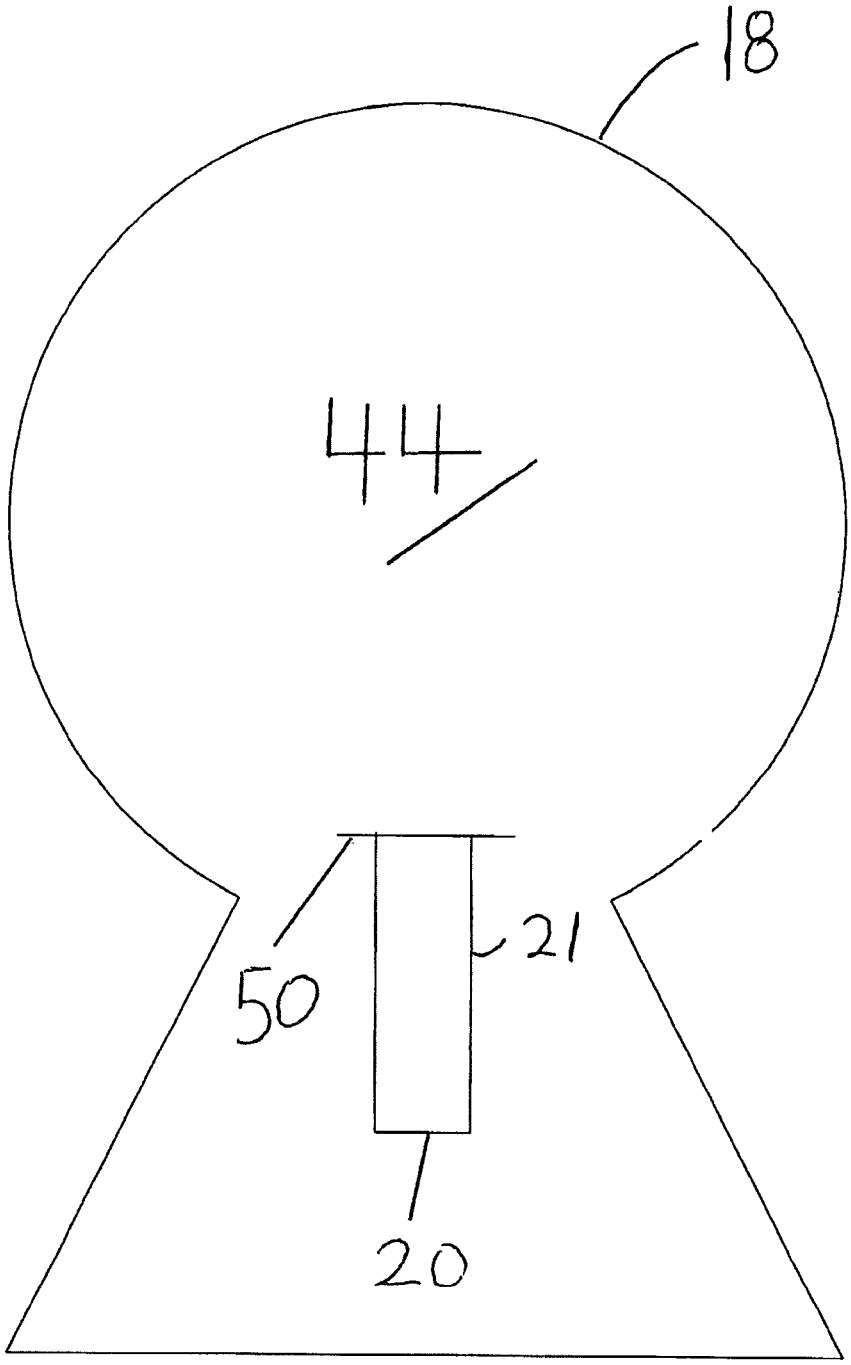
FIG. 5 is a plan view of the first side of the patch.
Figure 6:
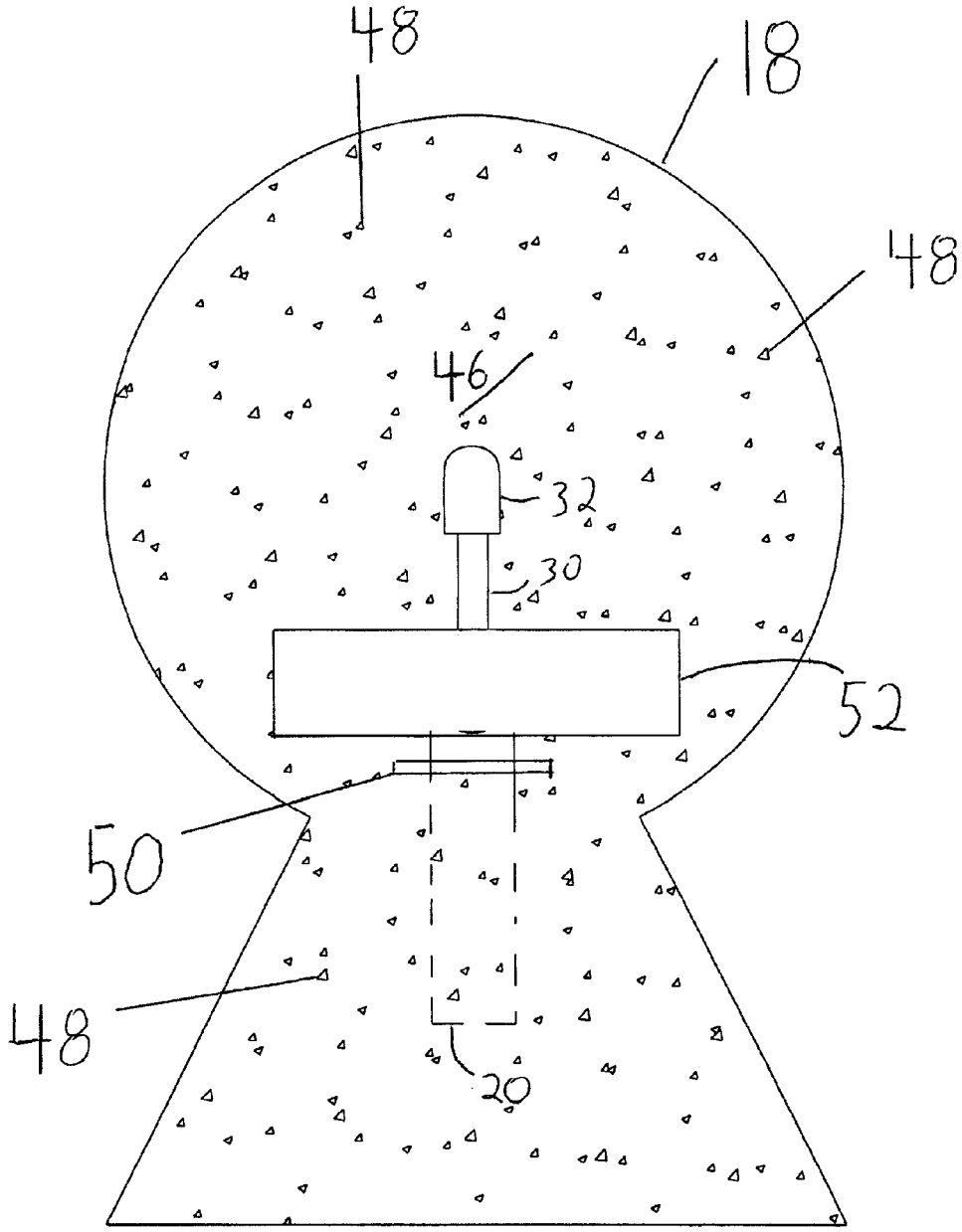
FIG. 6 is a plan view of the second side of the patch.

Assembly 10 includes light assembly patch 18. Patch 18 is attached to the outer surface 14 of balloon 12. Patch 18 has adhesive 48 disposed on second side 46 of patch 16. Second side 46 also has circuit board 28 attached thereto. In a preferred embodiment, second side 46 is formed of a reflective material. The securing of patch 16 to outer surface 14 of balloon 12 results in light 32 on light support arm 30 being pressed into the outer surface 14 of inflated balloon 12. Light support arm 30 has an angular orientation "x" relative to the surface of a substantially planer circuit board 28, as shown in FIGS. 3 and 4. Light support arm 30 is preferably oriented such that angle "x" is between about 0.degree.-60.degree. In a preferred embodiment, the angular orientation of angle "x" is about 45.degree. The angular orientation is sufficient to urge light support arm 30 and light 32 such that each of light support arm 30 and light 32 press into the outer surface 14 of inflated balloon 12. The pressing of light support arm 30 and light 32 into outer surface 14 of inflated balloon 12 produces a lighted balloon effect that is unique over each of lights on the outer surface or lights contained on the interior of an inflated balloon. Outer surface 14 contacts and partially envelopes light 32 and produces a unique illuminated balloon effect that does not occur with either lights placed with an inflated balloon or lights placed on the outside of an inflated balloon.

Patch 18 is attached to balloon 12, such that tab 21 is accessible from second side 46 of patch 16. First end 20 of tab 21 extends outward from slot 50 of patch 18. Tab 18 is slidably movable by grasping first end 20 and moving tab 21. Movement of tab 21 ultimately moves second end 22 of tab 21. Second end 22 of tab 21 is positioned between batteries 24 and contact 26 of circuit board 28. In an extended orientation, end 20 is moved outward from patch 18 and second end 22 is moved from position between batteries 24 and connector 26. Thus, when second end 22 is moved from this position, batteries 24 are in direct contact with contact 26. The direct contact between batteries 24 and contact 26 initiates flow of electricity and illuminates light 32. In order to cease illumination of light 32, first end 20 of tab 21 is pushed inward towards balloon 12. Second end 22 of tab 21 is moved and positioned between batteries 24 and contact 26 of circuit board 28. The positioning of second end 22 of tab 18 between batteries 24 and contact 26 interrupts the flow of electricity to circuit board 28 and light 32 ceases to illuminate. Thus, movement of the tab 21 turns light 32 on and off.

It is further contemplated to utilize the patch as described herein and affix said patch to surfaces in which light can pass. Suitable surfaces include, clear, transparent, and translucent surfaces. Additionally, it is contemplated to use the patch affixed to a surface in which light can pass wherein the surface defines, at least a portion of a cavity, such that light is propagated through a particular structure.

Figure 7:
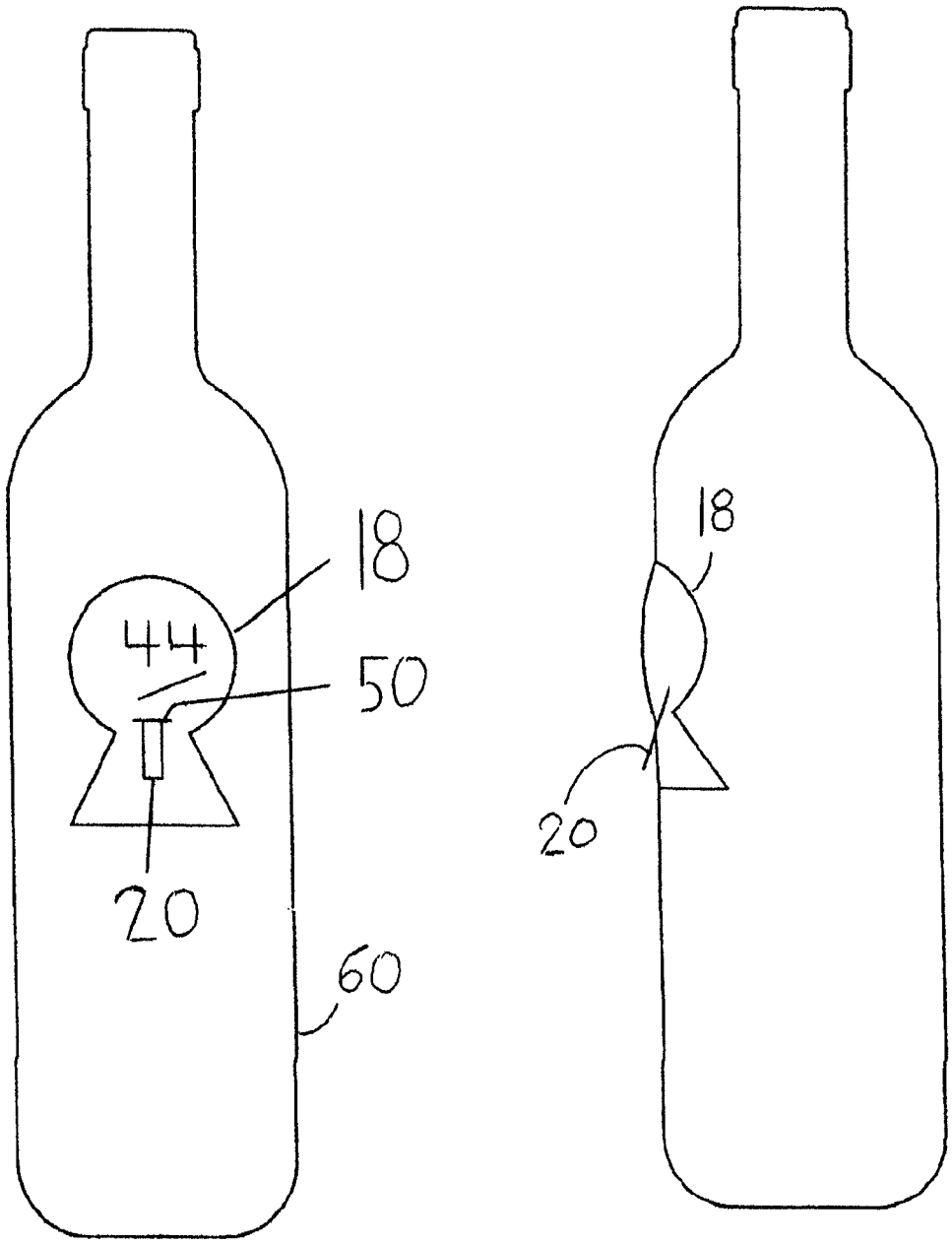
FIG. 7 are views of the patch affixed to a bottle.

By way of example, and not intended to be limiting, FIG. 7 depicts patch 18 of the present invention affixed to a bottle. The bottle is any of clear, transparent, translucent, or combinations thereof. The bottle has an interior cavity which may or may not be filled with matter that is also any of clear, transparent, translucent, or combinations thereof. The light from patch 18 as described herein, propagates and illuminates the interior of the bottle to produce an illuminated article effect.

Figure 8:
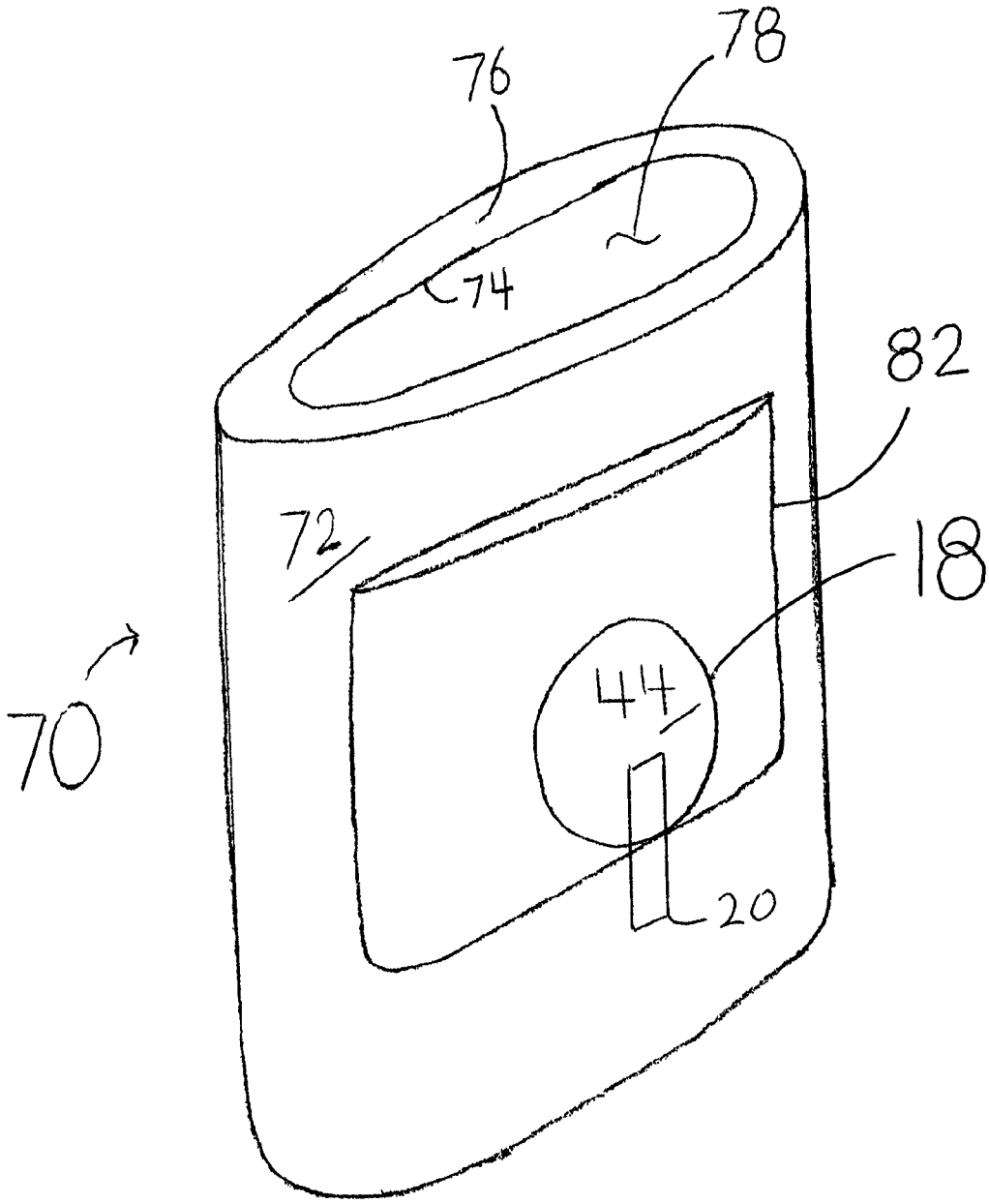
FIG. 8 is a perspective view of the patch affixed to an armband.
Figure 9:
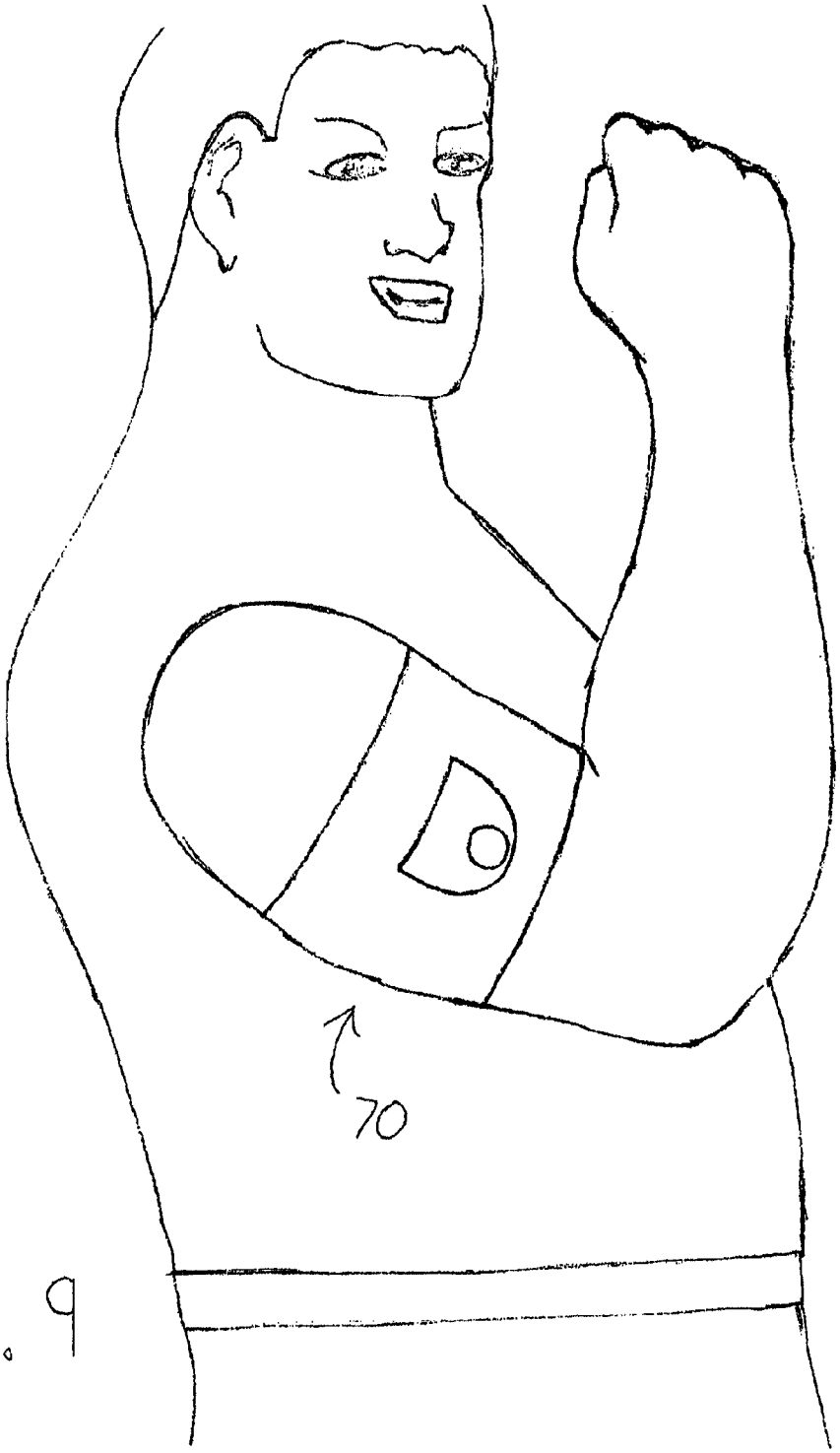
FIG. 9 shows an environment of use of the patch affixed to an armband.

In another embodiment, as shown in FIGS. 8 and 9, an armband 70 has an outer surface 72, an inner surface 74, and band cavity 78 defined by said inner surface. Armband 70 further has a structure cavity 76 defined between said outer surface 72, an inner surface 74. The structure cavity 76 is any of clear, transparent, translucent, or combinations thereof, and light from patch 18 is illuminated, the light propagates and illuminates the i structure cavity 76 to produce an illuminated article effect. The armband 70 appears to illuminate. Optionally, armband 70 may include surface support 82 which is any of clear, transparent, translucent, or combinations thereof. This support can be affixed to either an armband as described herein or to an armband of substantially opaque material. If opaque material is utilized, the illuminated effect is only achieved in support 82. Thus, the patch of the present invention can produce an illuminated effect on a conventional armband. As shown in FIG. 9, armband 70 is worn in a conventional manner.

In an embodiment of FIG. 10, inner surface 46 of patch 18 includes a plurality of light emitting structures 80. The light structures include, but are not limited to, light emitting diodes, fiber lights, light bulbs, lighted circuits, or combinations thereof.

Figure 11:
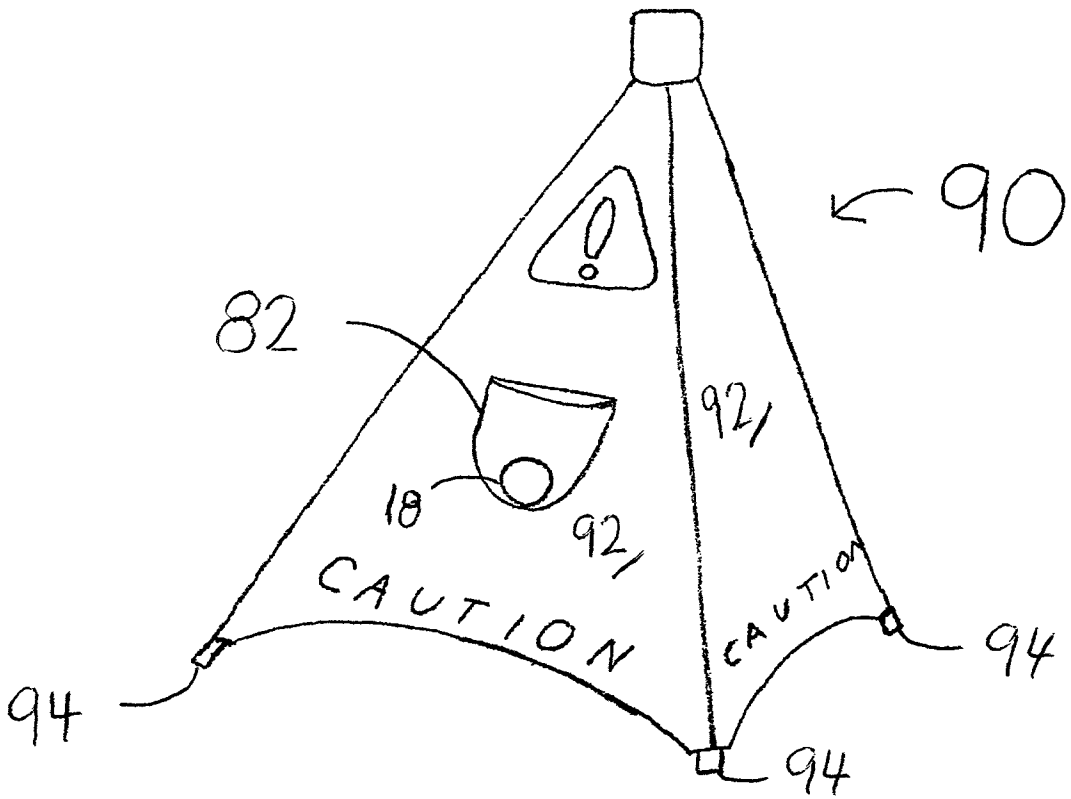
FIG. 11 shows an embodiment whereby the patch is affixed to a warning cone.

In the embodiment of FIG. 11, a warning or emergency cone 90 is used with patch 18. Patch 18 is particularly suitable in this environment because often warning cone 90 is often configured as collapsible or otherwise compactable which makes utilization with many lighting components difficult.

Cone 90 stands on base feet 94 and can have internal structure to define the shape. Cone 90 has outer surfaces 92 that are generally any of clear, transparent, translucent, or combinations thereof and define an inner cavity therein. Light patch 18 affixed to surface 92 emanates light into the interior region of cone 90 and provides an illuminated article effect as described herein.

Figure 12:
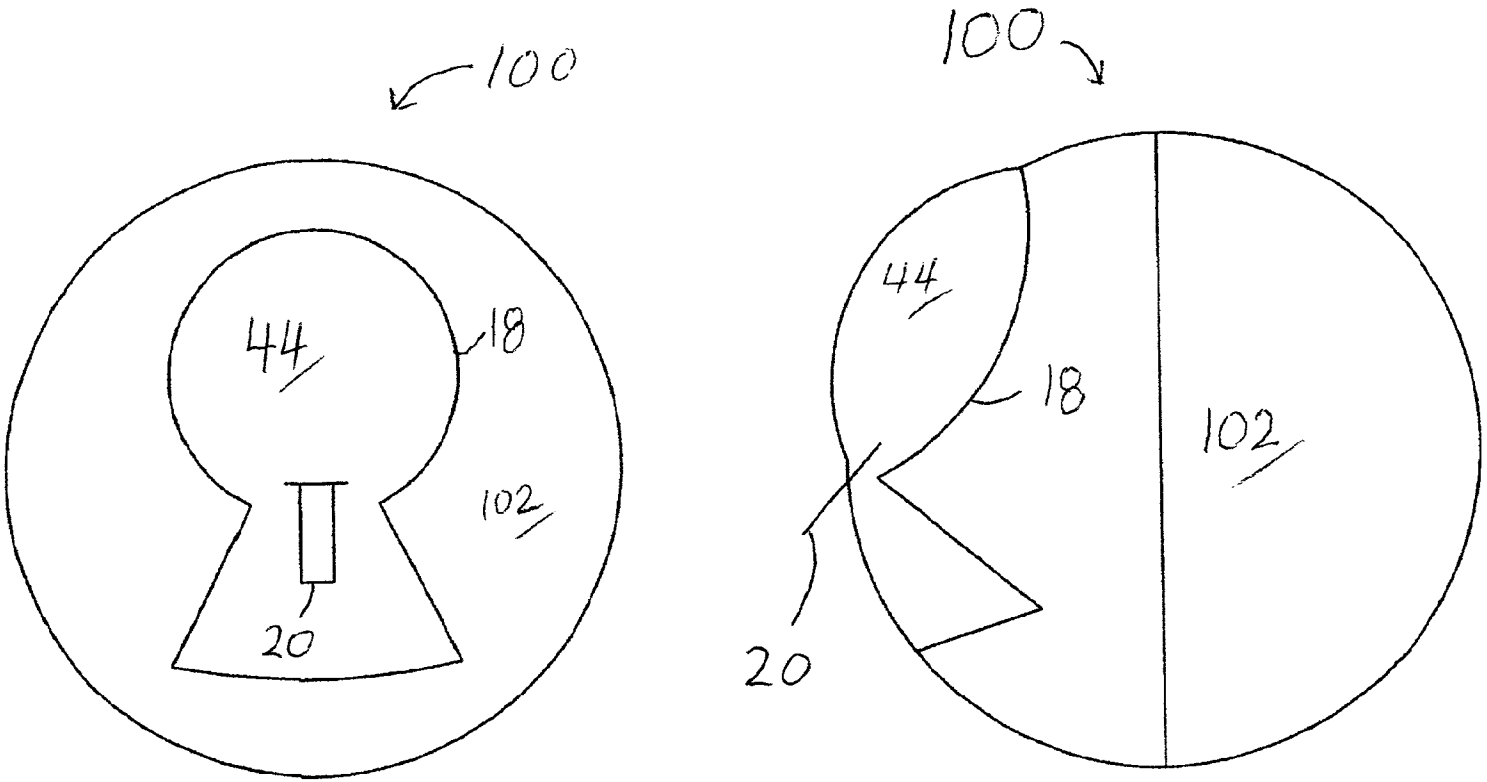
FIG. 12 shows an embodiment whereby the patch is affixed to a spherical article.

In the embodiment of FIG. 12, patch 18 is affixed to sphere 100. Sphere 100 has an outer surface 102 that is any of clear, transparent, translucent, or combinations thereof, wherein said surface 102 defines an inner cavity within sphere 100. Light patch 18 affixed to surface 102 emanates light into the interior region of sphere 100 and provides an illuminated article effect as described herein. In one embodiment, sphere 100 is a Christmas ornament.

Also contemplated is a method of illuminating an article comprising:

providing an article having an inner surface and an outer surface defining a body, said body constructed and arranged to have at least a portion thereof clear, transparent, translucent, or combinations thereof defining an interior;

providing an electric lamp assembly attached to a patch; said patch having a first side and a second side; said second side of said patch having said electric lamp assembly attached thereto; said second side of said patch further having adhesive disposed thereon, said adhesive for securing said patch to said outer surface; whereby said electrical light assembly comprises an electrical light positioned on said second side of said patch such that said light is disposed between said patch and said outer surface of said article;

activating said light;

whereby said activation illuminates said article.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. An illuminated display assembly, comprising: an article having an inner surface and an outer surface defining a body, said body constructed and arranged to have at least a portion thereof clear, transparent, translucent, or combinations thereof defining an interior; an electric lamp assembly attached to a patch; said patch having a first side and a second side; said second side of said patch having said electric lamp assembly attached thereto; said second side of said patch further having adhesive disposed thereon, said adhesive for securing said patch to said outer surface; whereby said electrical light assembly comprises an electrical light positioned on said second side of said patch such that said light is disposed between said patch and said outer surface of said article; said patch fixedly attached with adhesive to an outer surface of said article and structured and disposed to direct light into said interior and at least partially out through said article, thereby effectively illuminating said article; and an electrical power supply, wherein said electrical power supply includes a battery holder structured and arranged with a moveable tab accessible from the first side of said patch, whereby said moveable tab turns on and off said light.

2. The assembly of claim 1 wherein said light is supported by a light holder.

3. The assembly of claim 1 wherein said light includes a plurality of light emitting structures.

4. The assembly of claim 1 wherein said light includes a plurality of light emitting structures being light emitting diodes, fiber lights, light bulbs, lighted circuits, or combinations thereof.

5. The assembly of claim 1 wherein said article is a bottle, armband, warning cone, sphere, or Christmas ornament.

6. A method of illuminating an article comprising:

providing an article according to claim 1, having an inner surface and an outer surface defining a body, said body constructed and arranged to have at least a portion thereof clear, transparent, translucent, or combinations thereof defining an interior;

providing an electric lamp assembly attached to a patch; said patch having a first side and a second side; said second side of said patch having said electric lamp assembly attached thereto; said second side of said patch further having adhesive disposed thereon, said adhesive for securing said patch to said outer surface; whereby said electrical light assembly comprises an electrical light positioned on said second side of said patch such that said light is disposed between said patch and said outer surface of said article;

activating said light by removal a moveable tab accessible from the first side of said patch;

whereby said activation illuminates said article.

* * * * *